US008424165B1

(12) United States Patent
Moad

(10) Patent No.: US 8,424,165 B1
(45) Date of Patent: Apr. 23, 2013

(54) EXTENSION HANDLE FOR ROLLING LUGGAGE

(76) Inventor: Larry Moad, Reseda, CA (US)

( * ) Notice: Subject to any disclaimer, the term of this patent is extended or adjusted under 35 U.S.C. 154(b) by 974 days.

(21) Appl. No.: 11/762,263

(22) Filed: Jun. 13, 2007

Related U.S. Application Data

(60) Provisional application No. 60/813,196, filed on Jun. 13, 2006.

(51) Int. Cl.
*A47H 11/04* (2006.01)

(52) U.S. Cl.
USPC ..... 16/442

(58) Field of Classification Search ..... 16/422, 16/406, 426, 110.1
See application file for complete search history.

(56) References Cited

U.S. PATENT DOCUMENTS

| | | | | |
|---|---|---|---|---|
| 4,558,896 | A | 12/1985 | Farnworth | |
| 4,801,166 | A * | 1/1989 | Jordan et al. | 294/9 |
| 5,722,118 | A | 3/1998 | Hansen et al. | |
| 5,878,853 | A * | 3/1999 | DeRouen et al. | 190/116 |
| 6,134,743 | A * | 10/2000 | Schmidt | 15/236.01 |
| 6,301,749 | B1 * | 10/2001 | Chen | 16/429 |
| 6,360,402 | B1 * | 3/2002 | Crabtree | 16/430 |
| D463,124 | S | 9/2002 | Godshaw et al. | |
| 6,578,231 | B1 * | 6/2003 | Godshaw et al. | 16/114.1 |
| 6,662,406 | B2 * | 12/2003 | Shonfeld et al. | 16/431 |
| 6,711,784 | B2 * | 3/2004 | Walker | 16/436 |
| 6,728,994 | B1 * | 5/2004 | Rushin et al. | 16/426 |
| 6,920,667 | B2 * | 7/2005 | Joesten | 16/114.1 |
| 6,961,978 | B2 * | 11/2005 | Earley et al. | 16/406 |
| D523,789 | S * | 6/2006 | Caselberry | D12/133 |
| 2002/0116790 | A1 * | 8/2002 | Walker | 16/422 |

* cited by examiner

*Primary Examiner* — Victor Batson
*Assistant Examiner* — Matthew Sullivan
(74) *Attorney, Agent, or Firm* — Kenneth L Tolar

(57) ABSTRACT

A handle extension for increasing the effective length of a luggage handle includes an elongated tubular shaft having an upper end and a lower end. At the lower end are a pair of oppositely extending hooks that surround and engage opposing portions of the luggage handle. A pivotal lever is positioned on an intermediate portion of the shaft that engages the luggage handle handgrip to prevent the shaft from slipping through the handle assembly in the event that the shaft is released.

5 Claims, 3 Drawing Sheets

EXTENSION HANDLE FOR ROLLING LUGGAGE

CROSS REFERENCE TO RELATED APPLICATIONS

This application is entitled to the benefit of provisional application No. 60/813,196 filed on Jun. 13, 2006, the specification of which is incorporated herein by reference.

BACKGROUND OF THE INVENTION

The present invention relates to a uniquely designed handle that may be secured to a telescoping handle assembly on a rolling luggage item to increase the effective length thereof.

DESCRIPTION OF THE PRIOR ART

Most rolling style luggage items each include a telescoping handle assembly that is extended and grasped by a user to pull the luggage item along an underlying surface. However, those who are taller than average must stoop or bend to reach the handle assembly, which is uncomfortable and can cause or exacerbate certain spinal aliments. Creating a longer telescoping handle assembly is not a viable option because it must be fully extended to fix it in a deployed, operable position. The longer, fully extended handle assembly may then be too long for shorter users. Therefore, there is currently a need for a device that allows a user to selectively extend the effective length of a luggage handle. The present invention addresses this need by providing an extension handle that can be quickly secured to a luggage handle assembly thereby increasing the effective length thereof.

SUMMARY OF THE INVENTION

The present invention relates to a handle extension for increasing the effective length of a luggage handle including an elongated tubular shaft having an upper end and a lower end. At the lower end are a pair of oppositely extending hooks that surround and engage opposing portions of the luggage handle. A pivotal lever is positioned on an intermediate portion of the shaft that engages the luggage handle handgrip to prevent the shaft from slipping through the handle assembly in the event that the shaft is released.

It is therefore an object of the present invention to provide a device that selectively extends the effective length of a luggage handle.

It is another object of the present invention to provide a device that eliminates the problems associated with short luggage handles.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
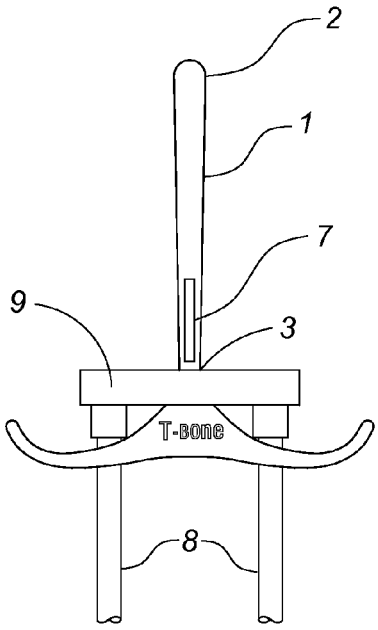
FIG. 1 is a front, plan view of the handle extension secured to a luggage handle.
Figure 2:
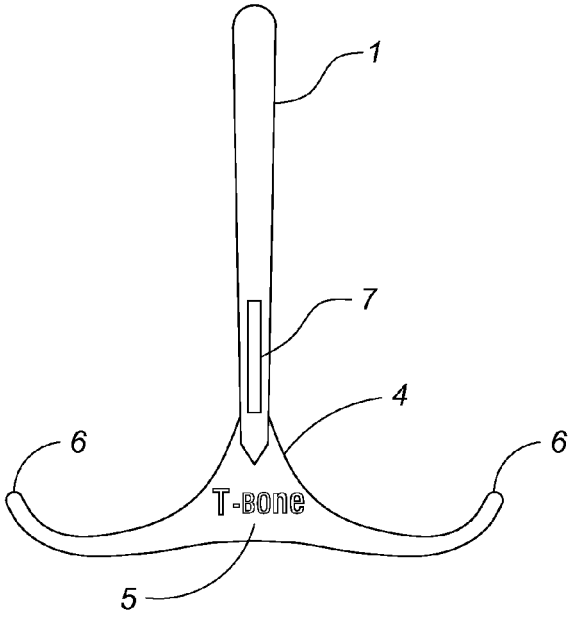
FIG. 2 is a front, plan view of the handle extension.
Figure 3:
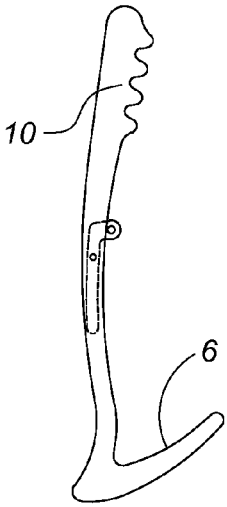
FIG. 3 is a side view of the handle extension.
Figure 4:
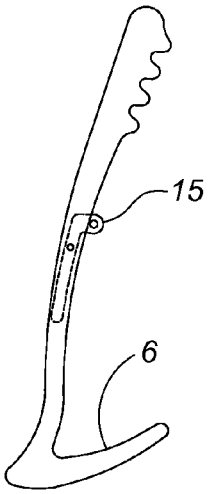
FIG. 4 is a side view of the handle extension with the lever pivoted to a substantially retracted, vertical position.
Figure 5:
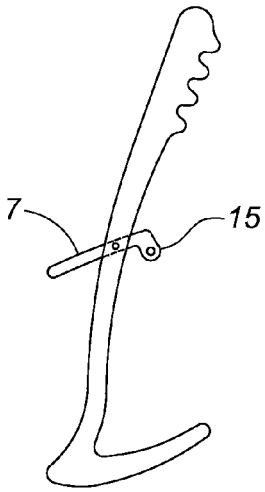
FIG. 5 is a side view of the handle extension with the lever pivoted to a substantially deployed, horizontal position.

The present invention relates to an extension handle for rolling luggage. The device comprises an elongated tubular shaft 1 having an upper end 2 and a lower end 3. The upper end is contoured for enhanced comfort when grasped by a user, and preferably includes a corrugated handgrip 10. Attached to the lower end is gripping member 4 including a central portion 5 with a pair of oppositely extending, diverging arcuate hooks 6 extending rearwardly therefrom. The length of each hook is such that it would encompass the telescoping handle assembly of most luggage, regardless of the width thereof. On an intermediate portion of the shaft is a lever 7 that is pivotal between a substantially horizontal and a vertical position. The lever includes a thumb tab 15 that a user grasps to pivot the lever between its two positions.

To extend the effective length of a telescoping handle assembly, a user inserts the upper end of the shaft between the spaced, telescoping arms 8 that are typically found on an extendable luggage handle assembly. The shaft is then lifted until each of the hooks surrounds the upper ends of the telescoping arms 8 at a position immediately beneath a handgrip section 9. If necessary, the lever is pivoted to a horizontal position so that it engages the upper surface of the handgrip section if the device is released. Therefore, a user can briefly release the shaft to perform other tasks without risk of the shaft disengaging the handle assembly.

Figure 6:
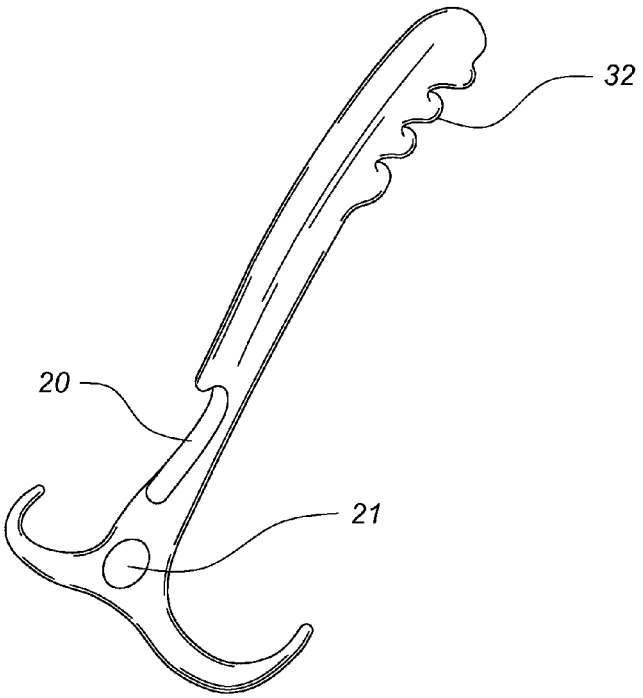
FIG. 6 depicts a slightly different embodiment of the present invention.
Figure 7:
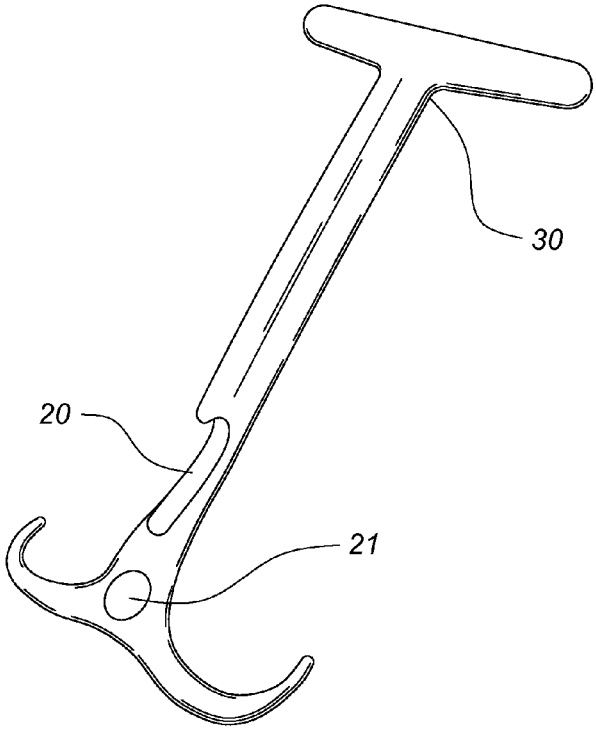
FIG. 7 depicts a slightly different embodiment of the handle of FIG. 6.
Figure 8:
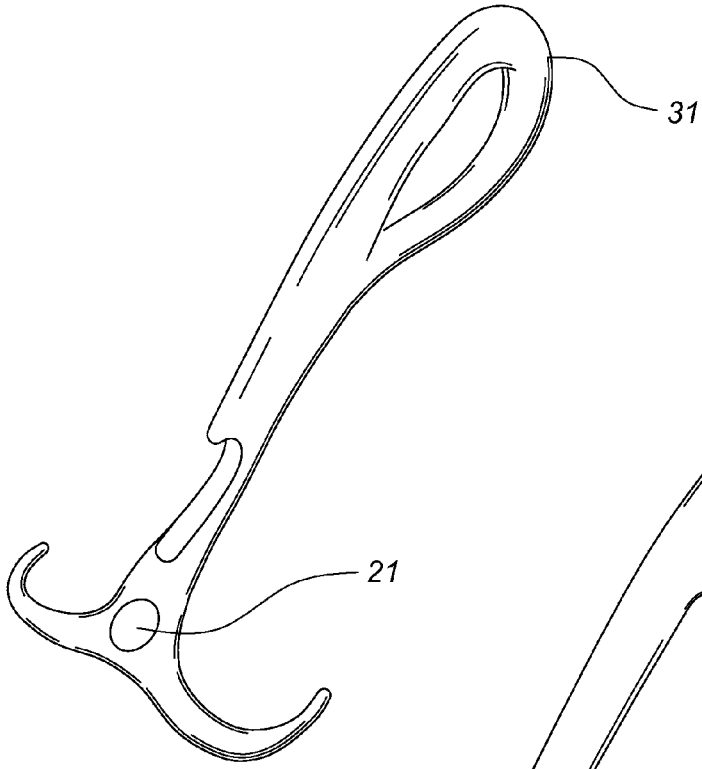
FIG. 8 depicts yet a third embodiment of the present invention.

Now referring to FIGS. 6-8, a slightly different embodiment is depicted wherein a notch 20 is formed on the shaft in lieu of the pivotal lever. The notch rests on an upper portion of the luggage handle to retain the device thereon. Between each hook is a receptacle that removably receives an embossed disc 21 for displaying corporate or teams logos and similar indicia. At an upper end of the shaft is a T-handle 30 for those who prefer to grasp a handle similar to that of the luggage, a loop 31 for those with a weakened grip or a linear, contoured handle 32 similar to that depicted in FIGS. 1-5.

Figure 10:
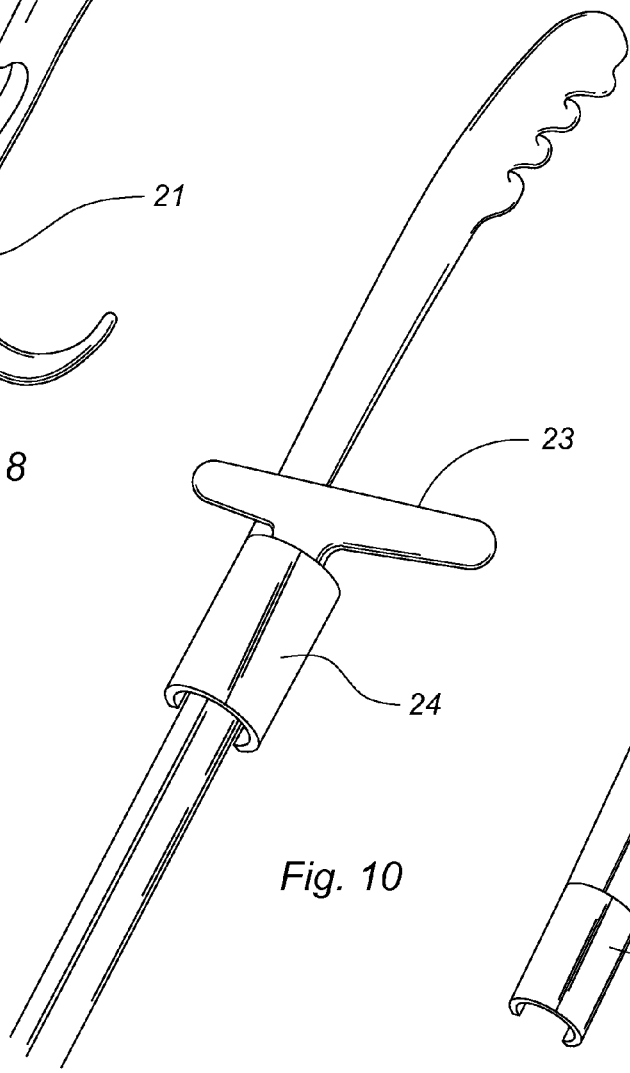
FIG. 10 depicts the device of FIG. 9 secured to a T-shaped luggage handle.
Figure 9:
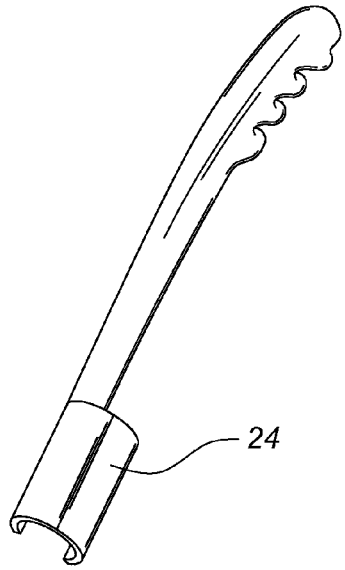
FIG. 9 depicts a fourth embodiment of the present invention.

Yet another embodiment is depicted in FIGS. 9 and 10, which is primarily designed for luggage having an extendable T-shaped handle 23. At a lower end of the shaft is a semi-cylindrical sleeve 24 that engages the horizontal portion of the T-shaped handle. Any one of the aforementioned handgrips or handles is provided on the upper end of the shaft.

The above described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An extension handle for rolling luggage comprising:

an elongated tubular shaft having an upper end and a lower end;

a gripping member at the lower end for engaging a telescoping luggage handle assembly, said gripping member including a central portion with a pair of oppositely extending, diverging arcuate hooks extending rearwardly therefrom, each of said hooks having an upturned distal end for gripping said handle assembly;

a lever on an intermediate portion of the shaft, said lever pivotal between a substantially horizontal and a vertical position so as to engage said telescoping luggage handle assembly when said shaft is released to retain said shaft on said handle.

2. The extension handle for rolling luggage according to claim 1 wherein the upper end of said shaft includes a corrugated handgrip.

3. The extension handle for rolling luggage according to claim 1 wherein said gripping member is a semi-cylindrical sleeve.

4. The extension handle for rolling luggage according to claim 1 wherein the upper end of said shaft includes a loop which is grasped by a user.

5. The extension handle for rolling luggage according to claim 1 wherein the upper end of said shaft includes a T-shaped handle member which is grasped by a user.

* * * * *